US006694954B2

(12) United States Patent
Fraenkle et al.

(10) Patent No.: US 6,694,954 B2
(45) Date of Patent: Feb. 24, 2004

(54) FUEL INJECTION SYSTEM FOR AN INTERNAL COMBUSTION ENGINE

(75) Inventors: Gerhard Fraenkle, Remshalden-Grunbach (DE); Volker Schwarz, Weinstadt (DE)

(73) Assignee: DaimlerChrysler AG, Stuttgart (DE)

( * ) Notice: Subject to any disclaimer, the term of this patent is extended or adjusted under 35 U.S.C. 154(b) by 1 day.

(21) Appl. No.: 10/113,626

(22) Filed: Mar. 27, 2002

(65) Prior Publication Data

US 2002/0148442 A1 Oct. 17, 2002

(30) Foreign Application Priority Data

Mar. 29, 2001 (DE) ..... 101 15 401

(51) Int. Cl.[7] ..... F02M 37/04
(52) U.S. Cl. ..... 123/506; 123/446; 123/514
(58) Field of Search ..... 123/496, 506, 123/458, 467, 514

(56) References Cited

U.S. PATENT DOCUMENTS 4,971,016 A * 11/1990 Peters et al. ..... 123/500
5,740,782 A * 4/1998 Lowi, Jr. ..... 123/446
6,148,791 A * 11/2000 Fujieda et al. ..... 123/295
6,247,450 B1 * 6/2001 Jiang ..... 123/446
6,314,941 B1 * 11/2001 Gant et al. ..... 123/446
6,336,444 B1 * 1/2002 Suder ..... 123/496
6,394,072 B1 * 5/2002 Yoshida et al. ..... 123/506
6,536,416 B1 * 3/2003 Mahr et al. ..... 123/506

FOREIGN PATENT DOCUMENTS

DE 199 21 878 11/2000

* cited by examiner

*Primary Examiner*—Carl S. Miller
(74) *Attorney, Agent, or Firm*—Klaus J. Bach

(57) ABSTRACT

In a fuel injection system for an internal combustion engine with a high pressure pump for supplying pressurized fuel to fuel injection valves and a multi-way valve disposed in the high pressure fuel line to the fuel injector for controlling the fuel flow to the injector, the multi-way valve is a spool valve which includes an actuator for positioning the spool to provide selectively a flow connection between the high pressure pump and the injection valve or between the injection valve and a fuel return line and which further includes an inflow throttle structure forming a pressure control device. A pressure sensor is arranged between the spool valve and the fuel injector and supplies the sensed pressure value to a controller which compares the value with predetermined set values and provides a correction value to the multi-way valve actuator for the correction of the pressure of the fuel supplied to the fuel injection valve.

2 Claims, 1 Drawing Sheet

FUEL INJECTION SYSTEM FOR AN INTERNAL COMBUSTION ENGINE

BACKGROUND OF THE INVENTION

The invention relates to a fuel injection system for an internal combustion engine, with a high-pressure pump for pressurizing the fuel and at least one injection valve, with a supply line, which connects the high-pressure pump to the injection valve. The fuel supply line includes a multi-way spool valve with a valve housing in which a valve spool is movable by an actuator, such that a flow connection can be established from the high-pressure pump to the injection valve or from the injection valve to a return located at the low-pressure side of the fuel system and, furthermore, with a supply flow throttle in the flow connection.

DE 199 21 878 A1 discloses a fuel injection system for an internal combustion engine, in which a multi-way valve which is activated by a solenoid valve and which has a pressure control piston is arranged between a high-pressure accumulator and an injector. In this system, the injection pressure can be set in a controlled manner only within specific limits. Tolerances unavoidably occurring along the injection-pressure profile cannot be compensated by means of this system.

It is the object of the present invention to improve a fuel injection system of this type, to the effect that, in the event of tolerances occurring along the injection-pressure profile, these tolerances can be effectively counteracted by simple measures.

SUMMARY OF THE INVENTION

In a fuel injection system for an internal combustion engine with a high pressure pump for supplying pressurized fuel to fuel injection valves and a multi-way valve disposed in the high pressure fuel line to the fuel injector for controlling the fuel flow to the injector, the multi-way valve is a spool valve which includes an actuator for positioning the spool to provide selectively a flow connection between the high pressure pump and the injection valve or between the injection valve and a fuel return line and which further includes an inflow throttle structure forming a pressure control device. A pressure sensor is arranged between the spool valve and the fuel injector and supplies the sensed pressure value to a controller which compares the value with predetermined set values and provides a correction value to the multi-way valve actuator for the correction of the pressure of the fuel supplied to the fuel injection valve.

With the fuel injection system according to the invention, the injection pressure can be fully and accurately controlled. The influence of the component tolerances on the injection can be at least largely eliminated. Because the pressure is continuously monitored, malfunctions of the fuel injection system can also be detected at an early stage and possible damage can be avoided.

The system according to the invention can easily be used in existing fuel injection systems as a retrofit solution, specifically as a component in which the regulating valve, sensor technology, actuator and controller are integrated. Only the corresponding power supply and the connection to a central computer for transmitting the desired pressure values are required.

The fuel injection system according to the invention is described below on the basis of the accompanying drawings.

DESCRIPTION OF A PREFERRED EMBODIMENT

Figure 1:
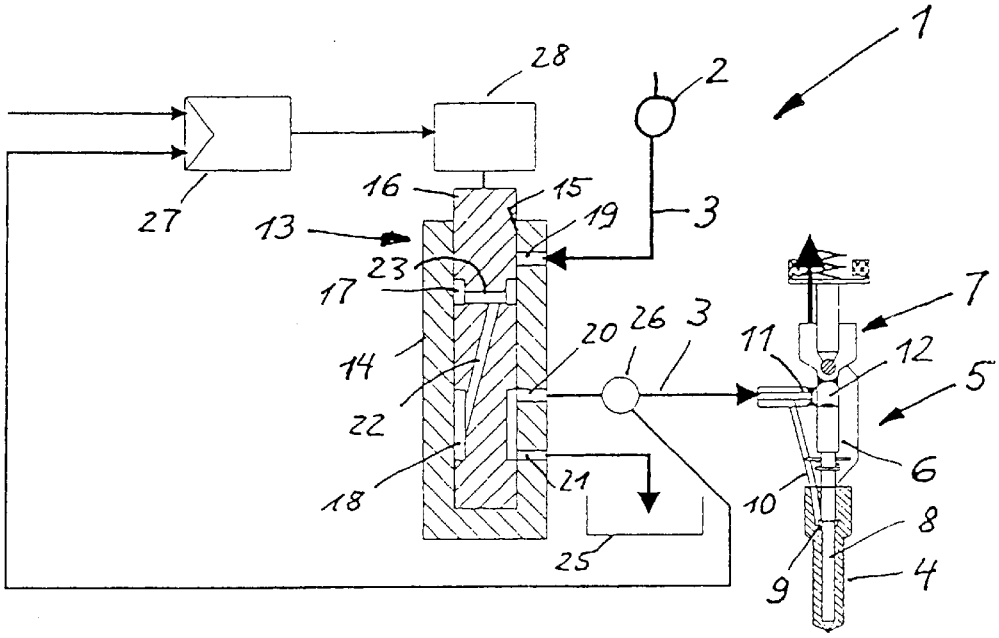
FIG. 1 shows a fuel injection system with a regulating valve arranged in the fuel supply line and with a pressure sensor.

A fuel injection system 1 as shown in FIG. 1 corresponds to a common-rail injection system which includes a rail as a high-pressure accumulator 2, a supply line 3 and an injection valve 4, which is part of a solenoid-valve-controlled injector 5. The solenoid-valve-controlled injector has a spring-loaded control piston 6 and a solenoid valve 7 fastened to the head part of the injector 5.

The injection valve 4 includes a nozzle needle 8 which is connected to the control piston 6 and which is surrounded by a pressure chamber 9, to which a fuel duct 10 extends from the supply line 3. A further fuel duct 11 extends from the supply line 3 to a control space 12 delimited by the control piston 6.

A multi-way valve with control passages is interposed in the supply line 3 between the high-pressure accumulator 2 and the injector 5. The valve is preferably a regulating spool valve 13, which includes a housing 14 having a cylindrical receiving bore 15 for a spool 16 that is longitudinally displaceable in the bore 15.

The passage cross-sections in the regulating valve 13 are formed, on one hand, by an upper small circumferential groove 17 provided on the spool 16 and a lower large circumferential groove 18 and, on the other hand, by three radial bores 19, 20, 21 located at a distance from one another in the valve housing 14.

The circumferential grooves 17 and 18 are likewise arranged at a distance from one another, and are connected to one another by means of a diagonally extending connecting bore 22. The connecting bore 22 may communicate at its upper end with a transverse bore 23 which passes through the spool 16 and in turn communicates with the upper circumferential groove 17.

This circumferential groove 17 has a small groove width which corresponds at least to the diameter of the radial bore 19 connected to the supply line 3. The circumferential groove 17 and the radial bore 19 form, depending on the position of the spool 16, a variable inflow throttle 24.

Figure 2:
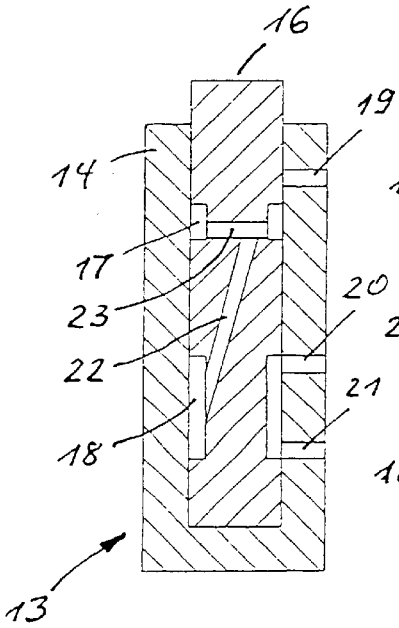
FIG. 2 shows the regulating valve in the relief position.

The lower circumferential groove 18 has a relatively large groove width which, when the spool 16 is in the relief position as shown in FIG. 2 covers the two lower radial bores 20 and 21. A relief connection is thus made from the injector 5 to a tank 25.

Arranged in the supply line 3 between the control valve 14 and the injector 5 is a pressure sensor 26 which feeds back the current injection pressures to an electronic controller 27. The controller 27 calculates from the measured current injection pressure and a set pressure value the necessary connecting cross section or the throttling required for generating the desired pressure.

The set pressure value is determined from a performance graph predetermined by an engine control unit (not illustrated). In the engine control unit, the set pressure values are stored as a function of load and rotational speed in the form of characteristic diagrams.

By means of a correction value determined by the controller 27, an actuator 28 connected mechanically to the spool 16 of the regulating valve 14 can adjust the variable inflow throttle 24. The actuator 28 can adjust the spool 16 piezo-electrically or electromotively.

Figure 3:
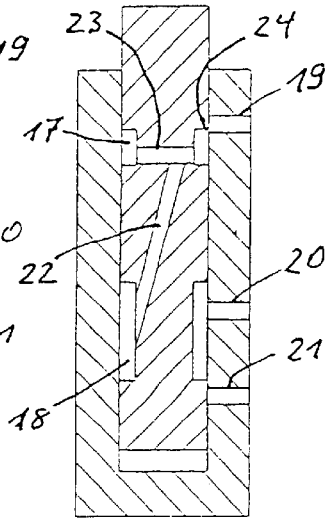
FIG. 3 shows the regulating valve in the throttle position.
Figure 4:
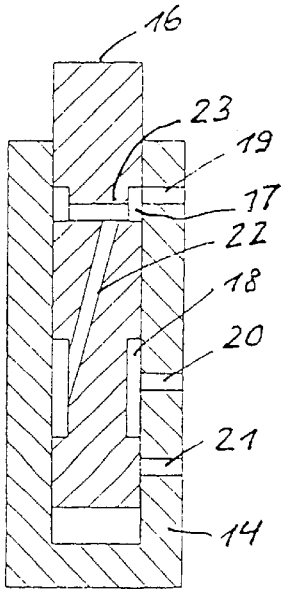
FIG. 4 shows the regulating valve in the unthrottled position, In each case, the valve is shown on an enlarged scale and in a sectional illustration.

The operation of the fuel injection system is explained on the basis of the exemplary embodiment with reference to FIGS. 2 to 4 of the drawings.

In the relief position during injection intermission according to FIG. 2, the injector 5 is connected by way of the return to the tank 25, that is to say the injector 5 is relieved of pressure. In the injection phase according to FIG. 3, the connection between the injector 5 and the return is closed and a flow connection is established from the high-pressure accumulator 2, via the supply line 3 and the passages in the regulating valve 13, to the injector 5. In this case, only part of the connecting cross-section (throttle position) formed by the radial bore 19 and circumferential groove 17 or the entire connecting cross-section, that is to say, the unthrottled position according to FIG. 4, is available, depending on the position of the spool 16. The variable connecting cross-section corresponds to the variable throttle opening 24 (FIG. 3).

The pressure sensor 26 constantly measures the momentary injection pressure value. The electronic controller 27 calculates from this injection pressure value and the set pressure value the necessary connecting cross-section or the throttle position required for generating the desired pressure. By means of the correcting variable as determined by the controller 27, the actuator 28 can set the spool 16 to the desired throttle position.

What is claimed is:

1. A fuel injection system for an internal combustion engine, comprising a high-pressure pump for pressurizing fuel, at least one injection valve, a fuel supply line connecting the high-pressure pump to said injection valve, a multi-way spool valve with a valve housing having a number of passages and including a spool which is longitudinally displaceably disposed in said valve housing and one of an electromotive and a piezoelectric actuator connected mechanically to said spool for positioning said spool so as to provide a flow connection selectively between the high-pressure pump and the injection valve and between the injection valve and a return line, said spool valve including a flow throttle structure forming a variable throttle, and a pressure sensor arranged between said spool valve and the injection valve which pressure sensor detects the actual injection pressure and feeds the actual pressure value back to an electronic controller which, after a comparison of the actual pressure value with a set pressure value, determines a correction value for the actuator co-operating with said spool valve for adjusting the spool position, said spool valve passages comprising three radial bores in the valve housing which are located at a distance from one another and a transverse bore and circumferential grooves arranged at a distance from one another at the outer circumference of said spool, and also a connecting bore interconnecting said circumferential grooves in said spool and arranged in such a way that the spool, in a first position corresponding to the relief position, provides for a flow connection from the injection valve to the return located on the low-pressure side, in a second position, opens a throttled flow connection from the high-pressure pump to the injection valve and, in a third position, fully opens this flow connection.

2. A fuel injection system according to claim 1, wherein a variable throttle is formed by a radial fuel inlet bore in the valve housing which is connected to the fuel supply line and by the circumferential groove in the spool adjacent said fuel inlet bore, the passage-determining throttle cross-section being dependent on the position of the spool as set by said actuator.

* * * * *